US005467956A

United States Patent [19]

Herr

[11] Patent Number: 5,467,956

[45] Date of Patent: Nov. 21, 1995

[54] SHEET ROLL DISPENSER

[76] Inventor: Boone D. Herr, Rte. 1, Box 23, Viroqua, Wis. 54665

[21] Appl. No.: 73,668

[22] Filed: Jun. 8, 1993

[51] Int. Cl.[6] ..... A47F 5/00

[52] U.S. Cl. ..... 248/309.2; 211/16; 242/423.1; 242/597.7

[58] Field of Search ..... 248/309.2, 300; 242/55.2, 597.7, 423.1; 211/16, 59.2

[56] References Cited

U.S. PATENT DOCUMENTS

| | | | |
|---|---|---|---|
| 958,062 | 5/1910 | Adkins | 242/423.1 |
| 1,292,640 | 1/1919 | Phelps | 242/55.2 |
| 1,888,426 | 11/1932 | Duby | 242/55.2 |
| 2,482,871 | 9/1949 | Rapport | 242/55.2 |
| 2,540,436 | 2/1951 | Fowler | 242/423.1 |
| 2,613,041 | 10/1952 | Cantrell | 242/423.1 |
| 2,717,472 | 9/1955 | Wilmington | 248/309.2 X |
| 2,739,840 | 3/1956 | Anderson | 242/55.2 |
| 2,928,618 | 3/1960 | Locke | 242/423.1 |
| 3,370,805 | 2/1968 | Barbee | 248/309.2 X |
| 3,806,055 | 4/1974 | Bauman | 242/55.2 |
| 4,273,299 | 6/1981 | Ness | 242/55.2 X |
| 4,373,682 | 2/1983 | Dickson | 242/55.2 |
| 4,720,053 | 1/1988 | Vance | 242/597.7 X |
| 5,100,075 | 3/1992 | Morand | 242/55.2 |
| 5,188,328 | 2/1993 | Thompson | 248/309.2 |

*Primary Examiner*—Ramon O. Ramirez
*Assistant Examiner*—Korie H. Chan
*Attorney, Agent, or Firm*—Alfred F. Hoyte, Jr.

[57] ABSTRACT

A sheet roll dispenser of unitary construction is provided. The dispenser has no moving parts and includes an abrasive surface upon which the sheet roll rests. The abrasive surface serves to limit overfeed of the sheet roll.

2 Claims, 2 Drawing Sheets

SHEET ROLL DISPENSER

BACKGROUND OF THE INVENTION

This invention relates to supports for roll material and particularly sheet roll dispensers or supports for roll material for such material as rolls of tissue, paper towels, foil, wax paper and the like.

The present sheet roll dispenser is designed so as to have a vertically extending bracket for mounting on a wall or other vertical surface, an outwardly extending support member, an upstanding cylindrical roll support member integrally formed with the vertical bracket and the outwardly extending support member thereby forming a roll holder of unitary construction.

The use of various sheet roll dispensers is well known in the prior art. One of the problems associated with the prior art is overfeed. This problem is particularly noticeable with sheet roll dispensers having a horizontal roll support member. The prior art has attempted to solve this problem by providing sheet roll dispensers having vertical roll support members. These prior art sheet roll dispensers tend to be large and typically require several moving pieces such as spring loaded clamps and the like which of course are ultimately subject to failure after repeated use. Also because of their non-unitary construction they tend to be relatively expensive to manufacture. Finally the mounting brackets for the prior art sheet roll dispensers tended to be large and required several screws or cement to secure them to the wall thereby presenting a serious problem when the dispenser has to be replaced or removed.

SUMMARY OF THE INVENTION

In view of the foregoing disadvantages inherent in the prior art sheet roll dispensers, the present invention provides a sheet roll dispensers of unitary construction, having no moving parts, and which is inexpensive to manufacture.

It is an object of this invention to provide a sheet roll dispenser having unitary construction and including a vertically extending bracket for mounting on a wall or other vertical surface, an outwardly extending support member having an abrasive surface, and an upstanding cylindrical roll support member.

It is another object of this invention to provide a sheet roll dispenser whereby overfeed is prevented by providing an abrasive surface upon which the roll rests when the dispenser is in use.

It is another object of this invention to provide a sheet roll dispenser which is of a durable and reliable construction.

It is another object of the invention to provide a sheet roll dispenser which is susceptible of a low cost of manufacture with regard to both materials and labor, and which accordingly is then susceptible of low prices of sale to the consuming public.

These and other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

FIG. 1(*b*) shows a frontal view of the wall mounted embodiment of the present invention.

FIG. 1(*c*) shows a side view of the wall mounted embodiment of the present invention.

FIG. 2(*b*) shows a frontal view of the free standing embodiment of the present invention.

FIG. 2(*c*) shows a side view of the free standing embodiment of the free standing.

DETAILED DESCRIPTION OF THE INVENTION

Figure 1C:
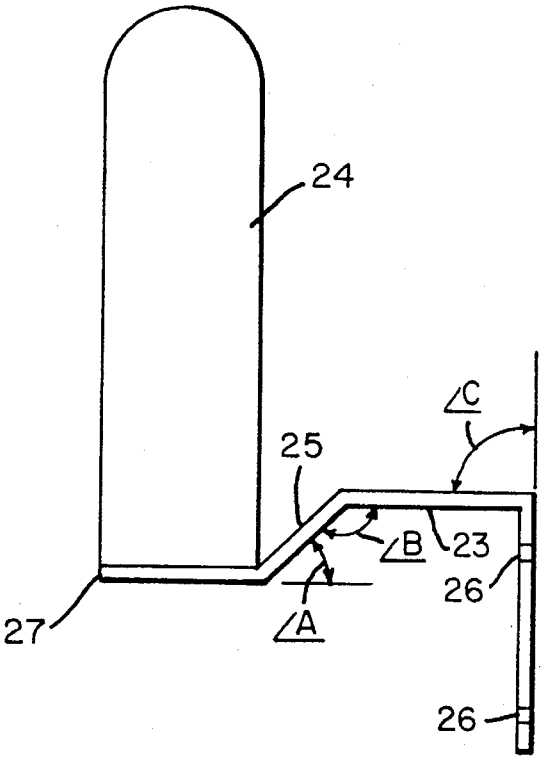
FIG. 1(*a*) shows a top view of the wall mounted embodiment of the present invention.
Figure 1B:
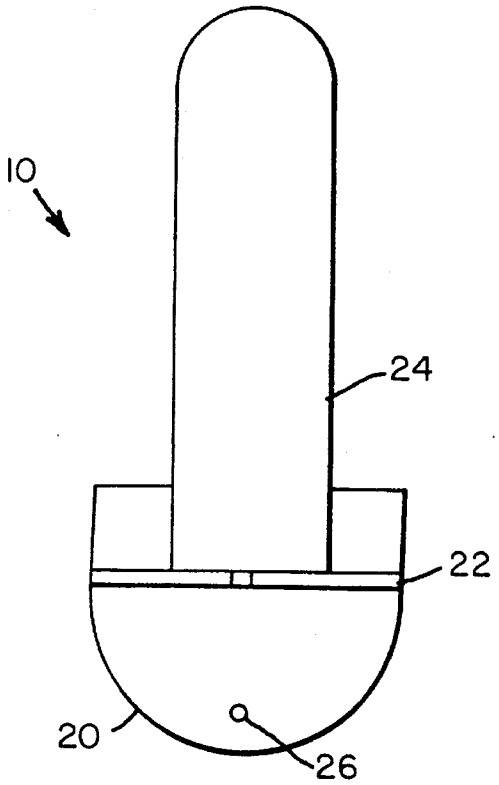
Figure 1A:
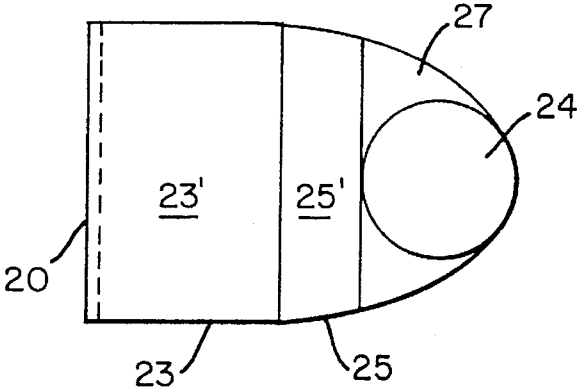
Figure 2A:
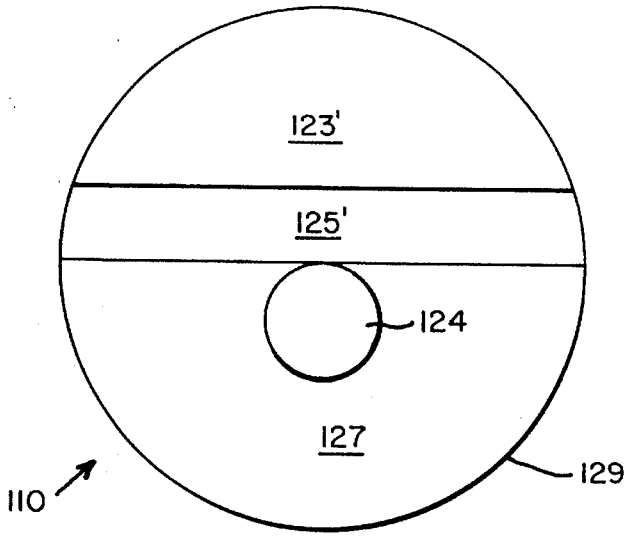
FIG. 2(*a*) shows a top view of the free standing embodiment of the present invention.
Figure 2B:
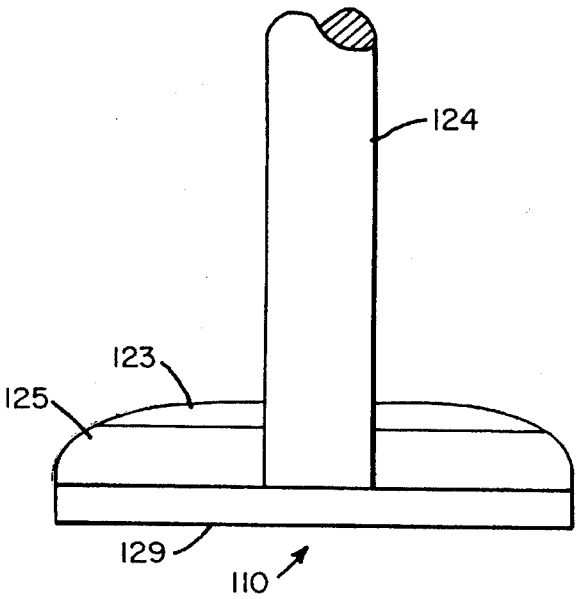
Figure 2C:
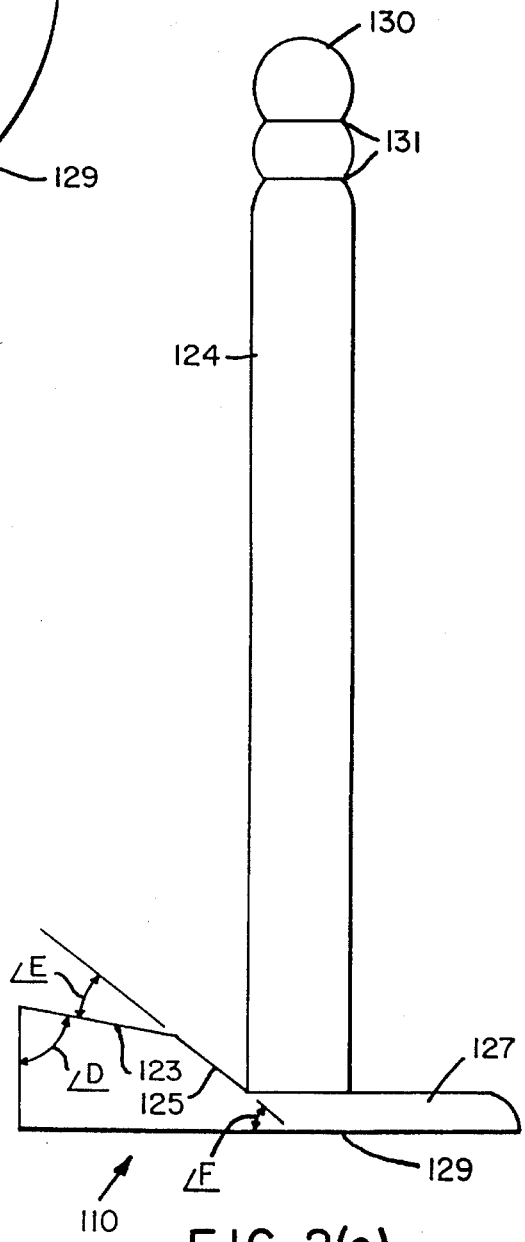

With reference now to the drawings, and in particular to FIGS 1 and 2 thereof the principles and concepts of the present invention generally designated by the reference numeral 10 will be described.

Referring now to FIG. 1, the sheet roll dispenser 10 essentially comprises a vertically extending bracket 20, an outwardly extending support member 22, and an upstanding cylinder 24 providing vertical roll support.

The bracket 20, and support member 22 are made small relative to the size of the roll to be supported. This allows for both mounting space and manufacturing cost to be minimized. The bracket 20 requires only two screws (not shown) for support. Apertures 26 are provided to receive the screws as is shown in FIG. 1(*b*). The apertures 26 are aligned with the upstanding cylinder 24. It can be readily appreciated that aligning the apertures 26 in this manner allows for horizontal displacement of the dispenser 10 without revealing the holes left by the previous mounting. This is an especially important feature when the screws are mounted in wood, plaster, or another surface where a new mounting will be required whenever the dispenser has to be replaced or removed, e.g., for painting.

As can be seen in FIG. 1(*a*) support member 22 is generally rectangular at the wall mounting side and gradually tapers to an arc shaped horizontally extending section 27 which supports upstanding cylinder 24. Angled sections 23 and 25 are formed in support member 22 and have abrasive top surfaces 23' and 25'. Upstanding cylinder 24 is set against section 25 to allow for proper feeding of the sheet roll down to the last sheet as will be explained later.

Referring now to FIG. 1(*c*) it can be seen that section 23 forms an angle A with the horizontal plane and an angle B with section 25. Angle C is measured between the wall (vertical plane) and section 25. Angles A, B, and C are chosen so as to provide for proper feeding of the sheet roll as it decreases in size. To achieve optimum feeding it has been determined that angle A should be about 40 degrees, angle B should be about 142 degrees, and angle C should be about 92 degrees. It should be noted here that the junction of sections 23 and 25 is meant to be rounded as a means to ensure smooth feeding.

In order to eliminate the overfeed problem the top surfaces 23' and 25' of the support member 22 are roughened. The texture of the surfaces 23' and 25' is similar to the texture of a conventional metallic fingernail file. Overfeed of the sheet roll is thus prevented by a combination of gravitational pressure and frictional engagement with the top surfaces 23' and 25' of support member 22. Accidental unrolling of the sheet roll by casual contact is thus eliminated and overfeed during normal use is substantially reduced.

It can be readily appreciated that the ability of the roll dispenser 10 to prevent overfeed is a function of the surface area as well as the texture of the surfaces 23' and 25'. For dispensing paper towels satisfactory feeding was obtained with an overall length (measured from the wall) of 4 9/16th inches and an initial width of 2¾ inches. For tissue paper dispensers a length of 5¼ inches and a width of 2¾ inches produced the The top end 30 of the upstanding cylinder 24 is rounded to guide the sheet roll onto the cylinder 24. The diameter of upstanding cylinder 24 is chosen to provide only a limited amount of free play between the interior of the sheet roll tube and the upstanding cylinder 24. This allows for smooth feeding of the sheet roll since frictional engagement of surfaces 23' and 25' is even. If the sheet roll tilts substantially with respect to upstanding cylinder 24 the frictional engagement with surfaces 23' and 25' will be in excess of that required for smooth feeding.

For dispensing conventionally available tissue rolls the optimum diameter for upstanding cylinder 24 has been found to be 1⅜ inches. For dispensing paper towels the optimum diameter is 1 13/32 inches. For non-conventional sheet rolls the above mentioned guidelines are applicable.

Upstanding cylinder 24, support member 22, and bracket 20 are integrally formed by injection molding or another similar process so as to form a dispenser 10 of unitary construction. Since the dispenser 10 of the present invention has no moving parts it is not subject to failure during normal use like prior art roll holders. It is well known that the spring constant of any spring will change and therefore any roll holder employing sting loaded members must eventually fail. Adding to the problem is the fact that the springs used are never of standard sizes thus requiring that the entire assembly be replaced.

In operation, a sheet roll is mounted on upstanding cylinder 24 and comes to rest on support member 22. The desired amount of material is dispensed and torn away using the customary downward motion. Initially only surface 23' applies friction to the sheet roll. This friction is applied almost totally to the underside of the roll. As the roll decreases in size it ultimately becomes wedged between upstanding cylinder 24 and surface 25'. In this position, due to the angle of section 25, friction is applied to both the side and the underside of the sheet roll thus resulting in increased frictional engagement. This is necessary since as the roll decreases in size it also decreases in weight. It can be readily appreciated that even a non-uniform abrasive surface for support member 22 would not solve the overfeed problem created by a lighter sheet roll since initially feeding would be difficult. Support member 22 rolls gradually from surface 23' to surface 25' so as to provide for uniform feeding of the sheet roll despite the reduction in weight which occurs as material is dispensed. Since upstanding cylinder 24 abuts surface 25' friction is applied down to the last sheet. Since section 27 does not have an abrasive surface improper feeding would result if upstanding cylinder 24 did not abut surface 25'.

Referring now to FIG. 2, an alternative embodiment of the present invention 110 is shown. This sheet roll dispenser 110 is free standing and portable. Like the wall mounted dispenser 10, the portable dispenser 110 relies on a combination of gravitional pressure and frictional engagement to achieve smooth, even sheet feeding while avoiding a tendency to overfeed.

The base 129 provides for vertical support of the dispenser 110. The base 129 is made sufficiently heavy to avoid displacement of the dispenser 110 during normal use. For paper towel dispensing an absolute minumum of 4 pounds is required for proper operation. Of course more weight can be used to add stability with ease of portability and cost being the most important limiting factors. The type of sheet roll material should be taken into account when determining the weight of the base since some materials are heavier than others. It should be noted here that since the dispenser 110 is made of a unitary construction the weight will be distributed under sections 123, 125, and 127. Any suitable high density material can be used to add weight to the base 129 with some type of metal being the most obvious example.

As has been previously stated, the principle of operation of the portable dispenser 110 is the same as the wall mounted dispenser 10. However, the fact that the portable dispenser is disposed on a surface must be taken into account since the downward motion associated with the wall mounted dispenser 10 cannot be used. A more horizontal motion must be used thus resulting in an increased tendency to overfeed. This tendency is controlled by making angles D, E, and F of FIG. 2(*c*) different from angles A, B, and C, of the wall mounted dispenser 10.

Angle F corresponds exactly to angle A of the wall mounted dispenser and is also 40 degrees. Angle E defines the relationship bewteen surfaces 123' and 125' and should be about 30 degrees. Angle E corresponds to angle B of the wall mounted dispenser 10. Angle D corresponds to angle C of the wall mounted dispenser 10 and should be about 80 degrees thus defining a 10 degree horizontal slope as opposed to the 2 degree slope of the wall mounted dispenser. This additional slope causes increased frictional engagement with surface 123' thus reducing the tendency to overfeed associated with the horizontal dispensing motion which is employed with a surface mounted dispenser.

Upstanding cylinder 24 of the portable model is made long enough to extend over the top of the sheet roll so as to provide a convenient handle for moving the dispenser 110. Grooves 131 can be provided at the top end 130 to provide for easier handling of the dispenser.

With respect to the above description it is to be realized that the optimum dimensional relationships for the parts of the invention, to include variations in size, materials, shape, form, function and manner of operation, assembly, and use, are deemed readily apparent and obvious to one skilled in the art,and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A sheet roll dispenser for storage and use of an individual roll of webbing formed with a hollow core of a predetermined diameter, said dispenser comprising: a vertical mounting bracket, a generally rectangular horizontal support member connected to said mounting bracket, said support member having an abrasive top surface and being formed in two sections, a first section extending from said mounting bracket, an angle section extending from said first section at a first predetermined angle and a second section extending from said angle section at a second predetermined angle different from said first predetermined angle, an upstanding cylinder formed in said horizontal support member, said mounting bracket, horizontal support member, and upstanding cylinder forming a sheet roll dispenser of unitary construction, said angle section of said support member along with said abrasive top surface minimizing overfeed when said sheet roll is relatively small.

2. The dispenser of claim 1 wherein said first and second angles are not equal.

* * * * *